US005660716A

United States Patent [19]

Bourgogne et al.

[11] Patent Number: 5,660,716

[45] Date of Patent: Aug. 26, 1997

[54] FLUIDIZED-BED CATALYTIC CRACKING PROCESS FOR A HYDROCARBON FEEDSTOCK, PARTICULARLY A FEEDSTOCK WITH A HIGH CONTENT OF BASIC NITROGEN COMPOUNDS

[75] Inventors: Michel Bourgogne, Le Havre; Thierry Patureaux, Montivilliers; Nathalie Boisdron, Le Havre, all of France

[73] Assignee: Total Raffinage Distribution S.A., Puteaux, France

[21] Appl. No.: 374,236

[22] Filed: Jan. 18, 1995

[30] Foreign Application Priority Data

Jan. 18, 1994 [FR] France ..... 94 00472

[51] Int. Cl.[6] ..... C10G 11/18

[52] U.S. Cl. ..... 208/163; 208/113; 208/114; 208/127; 208/159; 208/164

[58] Field of Search ..... 208/113, 103, 208/254 R, 148, 159, 114

[56] References Cited

U.S. PATENT DOCUMENTS

| | | | |
|---|---|---|---|
| 3,835,029 | 9/1974 | Larson | 208/113 |
| 4,411,773 | 10/1983 | Gross | 208/164 |
| 4,412,914 | 11/1983 | Hettinger, Jr. et al. | 208/253 |
| 4,693,808 | 9/1987 | Dewitz | 208/113 |
| 4,724,067 | 2/1988 | Raatz et al. | 208/120 |

FOREIGN PATENT DOCUMENTS 0 435 539 12/1990 European Pat. Off. .

OTHER PUBLICATIONS

English Abstract of Japan Patent Publication A-3,130.236 [Database WPI, Week 9128, Derwent Publications Ltd., London, GB, AN 204749] Jun. 1991.

*Primary Examiner*—Helane Myers
*Attorney, Agent, or Firm*—A. Thomas S. Safford

[57] ABSTRACT

A fluidized-bed process for catalytic cracking of a hydrocarbon feedstock where the hydrocarbon feedstock, particularly a feedstock with a high content of basic nitrogen compounds, and a catalyst circulate in the tubular zone co-currently from the top to the bottom, where the catalyst, which is under equilibrium conditions at 150° C., and a pressure of 5 mbar, adsorbs less than 250 micromols, and preferably less than 50 micromols, of pyridine/g, and whose pyridine retention, after heating at 350° C. under vacuum, does not exceed 20%, and preferably not 10%, of the amount adsorbed at 150° C.

20 Claims, 1 Drawing Sheet

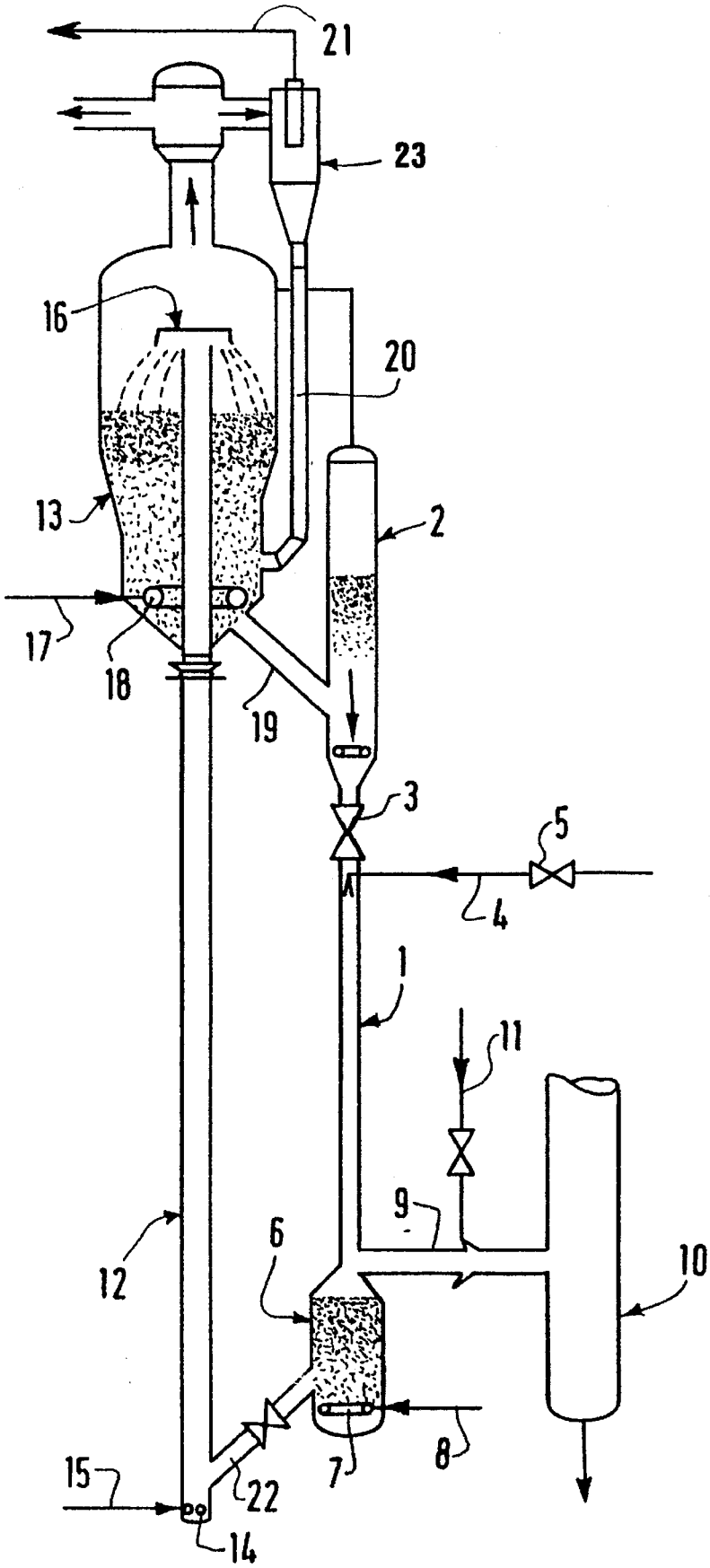
21
23
16
20
13
2
17
18
19
3
5
4
1
11
9
6
10
12
8
7
15
22
14

FLUIDIZED-BED CATALYTIC CRACKING PROCESS FOR A HYDROCARBON FEEDSTOCK, PARTICULARLY A FEEDSTOCK WITH A HIGH CONTENT OF BASIC NITROGEN COMPOUNDS

RELATED APPLICATIONS

This application claims priority to French Application No. 94.00472, filed Jan. 18, 1994, incorporated herein by reference.

FIELD OF THE INVENTION

The present invention relates to a fluidized-bed catalytic cracking process for a hydrocarbon feedstock, particularly a feedstock with a high content of basic nitrogen compounds.

BACKGROUND OF THE INVENTION

It is known that, in the petroleum industry, during the past fifty years, catalytic cracking of hydrocarbon feedstocks has progressively replaced thermal cracking. The fixed catalyst beds initially used have been rapidly replaced by mobile beds, particularly by fluidized beds, which led to the process currently known as fluidized-bed catalytic cracking or fluid catalytic cracking (FCC process).

In such processes, the cracking of the feedstock is carried out at a temperature of about 500° C. at a pressure close to atmospheric pressure and in the absence of hydrogen. During cracking, the catalyst becomes covered with coke and heavy hydrocarbons and is continuously regenerated outside the cracking reactor. The heat generated during regeneration by the combustion of the coke and of traces of residual hydrocarbons in the presence of air or oxygen brings the catalyst particles to the desired temperature, said particles then being recycled to the reactor.

Various types of catalysts can be used, and in this respect the reader is referred to, for example, U.S. patent Ser. No. 4,724,067 issued Feb. 9, 1988 to F. Raatz et al. or its European counterpart [EP]-A-0 206 871. Both patents are hereby incorporated herein by reference.

Said FCC processes produce automobile gasolines of much better quality and in much higher yields than do thermal cracking processes.

Said processes are usually carried out with upflowing catalyst particles, but this leads to a number of drawbacks because the gases present have a tendency to rise whereas the catalyst particles, because of their weight, resist ascending movement. As a result, in current reactors the C/O ratio of the catalyst flow rate "C" to the flow rate "O" of the feedstock to be treated is generally from 3 to 7 and usually close to 5.

More precisely, in an upflow reactor, the catalyst particles have a tendency to redescend, and the catalyst bed is supported and entrained by the vaporized feedstock to be cracked and by the lift gas. Hence, the catalyst flow rate "C" cannot be increased at will without risking an excessive slow-down in the rise of the catalyst particles. Downflow reactors obviously do not pose this problem.

These limitations of prior-art upflow reactors (also known as risers) manifest themselves particularly in the cracking of feedstocks with a high content of basic nitrogen compounds. The basic nitrogen compounds present in such feedstocks include, in particular, pyridine, quinoline, acridine, phenanthridine, hydroxyquinoline, hydroxypyridine and the alkyl derivatives thereof. With such feedstocks, the drop in conversion may be up to 15% compared to a normal feedstock. It is known, in fact, that basic nitrogen attaches itself to the active sites of the catalyst thus altering its catalytic properties.

Moreover, in upflow reactors, particles accumulate in the vicinity of the reactor walls which causes hydrocarbon overcracking in these areas. This gives rise to the formation of coke and hydrogen in place of the desired high-octane-number products and leads to insufficient feedstock conversion in the center of the reactor where fewer particles are present.

Moreover, although the catalyst particles, overall, rise in the reactor, some of them can locally redescend. This phenomenon, known as back-mixing, also results in a local drop in conversion, because the redescending particles are partially deactivated and exert a lesser effect on the feedstock than do the rising particles. This phenomenon is the more troublesome the lower the aforesaid C/O ratio.

To eliminate said drawbacks which make the catalytic cracking of feedstocks with a high basic nitrogen content very difficult and uneconomical, it has been proposed to subject the feedstocks to hydrotreatment which results in a reduction of the basic nitrogen content, but which requires high pressures and temperatures and, hence, is expensive.

To eliminate the basic compounds, it has also been proposed to use solid absorbents or solvents that are not miscible with the feedstock. Such a process, however, is long and costly.

The same is true for feedstock treatments with acid additives to neutralize the basic nitrogen compounds. For this reason, catalysts suitable for FCC processes and resistant to basic nitrogen have preferably been used (see "Nitrogen Resistance of FCC Catalysts" by J. Scherzer and D. P. McArthur, paper presented at "Katalistiks 7th Annual Cat Cracking Symposium", Venice, Italy, May 12–13, 1986), hereby incorporated herein by reference.

OBJECTS AND SUMMARY OF THE INVENTION

The present invention overcomes the drawbacks of the prior art by the surprisingly simple expedient of using a downflow FCC process with a cracking catalyst that is resistant to basic nitrogen compounds.

A purpose of said process is to make possible the cracking of hydrocarbon feedstocks containing more than 350 ppm by weight of basic nitrogen under favorable conditions. The nitrogen content may even be as high as 1300 ppm by weight or higher.

Another purpose of the invention is to suppress or limit the reactor wall effects in such a process and the back-mixing of catalyst particles.

Applicants have discovered that such an advantageous result can be attained by the conjoint use of

- a reactor wherein the feedstock to be treated and the fluidized catalyst bed move co-currently from the top to the bottom of the reactor in a manner which in itself is known;
- particles of a catalyst which under equilibrium conditions at 150° C. and at a pressure of 5 mbar adsorbs less than 250 micromols of pyridine/g and preferably less than 50 micromols of pyridine/g and whose pyridine retention does not exceed 20% after heating at 350° C. under vacuum.

Thus, the invention has as a preferred embodiment a fluidized-bed catalytic cracking process for a hydrocarbon feedstock, particularly a feedstock with a high content of basic nitrogen compounds, in a tubular reaction zone, said process comprising:

a step of feeding at least partly regenerated catalyst particles from the top of the reaction zone;

a step of introducing and atomizing the feedstock to be treated at the top of the reaction zone, below the catalyst feeding zone;

a step of circulating the catalyst and the feedstock to be treated in mutual contact in the reaction zone under suitable conditions to cause cracking of the feedstock;

a step of separating the deactivated catalyst from the products of the cracking reaction at the bottom of the reaction zone;

a step of stripping the deactivated catalyst;

a step of regenerating at least part of the stripped, deactivated catalyst in a regeneration zone;

a step of recycling the regenerated catalyst to the top of the reaction zone, and a step of transferring the products of the hydrocarbon feedstock cracking toward a separation zone for said products, said process being characterized by the fact that the feedstock and the catalyst circulate co-currently from the top to the bottom of the tubular zone and that under equilibrium conditions at 150° C. and a pressure of 5 mbar such that the catalyst adsorbs less than 250 micromols of pyridine/g and preferably less than 50 micromols of pyridine/g, and whose pyridine retention after heating at 350° C. under vacuum does not exceed 20%, and preferably not 10%, of the quantity adsorbed at 150° C.

As will be seen hereinbelow, the process according to the invention has the advantage of being suitable for the cracking of nitrogenous feedstocks under favorable conditions. This is true because, on the one hand, the low acidity of the catalyst which thus exhibits reduced activity is compensated for by the increase in reaction temperature made possible by the use of a downflow reactor and by the attendant reduction in reaction time and, on the other, the increase in reaction temperature shifts the adsorption-desorption equilibrium of the basic molecules on the acid sites of the catalyst toward desorption.

In fact, as the cracking reaction progresses in a downflow reactor (also known as downer or dropper), the velocity of movement of catalyst particles increases from the top to the bottom of the reactor and, at the exit from the reaction zone, is practically equal to that of the gas or about 25 m/s, which is much higher than in the upflow process.

Advantageously, the catalyst flow rate and thus the number of active sites can be increased. In particular, the weight ratio of catalyst to hydrocarbon present in the reactor advantageously exceeds 5 and preferably ranges from 7 to 15.

The novel catalyst can contain, for example, a limited amount, not more than 30 wt %, of alumina(s), and 15 to 40 wt % of at least one zeolite, the remainder up to 100% consisting of kaolin, basic or slightly acidic clay, such as sepiolite and vermiculite, a binder based on silica and optionally a metal scavenger, for example a metal oxide.

BRIEF DESCRIPTION OF THE DRAWINGS

In this specification and in the accompanying drawing, we have shown and described preferred embodiments of our invention and have suggested various alternatives and modifications thereof; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

FIG. 1 shows a schematic representation of a downflow FCC unit used for one exemplary preferred embodiment of the claimed process according to the present invention.

DETAILED DESCRIPTION OF THE INVENTION

As discussed previously, this invention relates to a downflow FCC process with a cracking catalyst that is resistant to basic nitrogen compounds.

The apparatus shown in FIG. 1 contains a downflow tubular reactor or downer i fed at its top with particles of regenerated catalyst coming from a vessel 2 which is concentrically in line with said reactor 1. First valve 3, used to regulate the weight ratio of catalyst to feedstock to be treated, is interposed between the reactor 1 and the vessel 2. Below first valve 3 enters a first line 4 fitted with a second valve 5 through which the hydrocarbon feedstock to be treated, preheated in a manner which in itself is known, is fed to the reactor 1. By means of injectors (shown schematically at the end of line 4 and located below valve 3 near the top of the reactor 1), said feedstock is atomized into fine droplets in the direction of the reactor bottom to cause said feedstock to mix with the catalyst particles (in contact with which particles the cracking reaction of the feedstock takes place). As will be seen hereinbelow, said particles have been brought to an appropriate cracking temperature by the catalyst regeneration operation. In the reactor 1, the catalyst particles and the feedstock to be treated thus flow co-currently from the top to the bottom.

At the bottom of said reactor, the catalyst particles flow into a stripping vessel 6 which at its bottom is fitted with a diffuser 7 fed with steam from a third line 8.

Also at the bottom of the reactor 1, above the vessel 6, is located a fourth line 9 through which the products of hydrocarbon cracking coming from the stripping vessel are removed toward a separation column 10. Before reaching said separation column 10, gas removed through the fourth line 9 may optionally be mixed with a hydrocarbon or with steam introduced into the fourth line 9 through a fifth line 11.

The stripped catalyst particles are removed from the stripping vessel 6 by gravity through an inclined line 22 and move toward an upflow column 12 in which they are carried upward toward a regenerator 13 with the aid of a carrier gas supplied from a sixth line 15 and diffused at a first diffuser 14 at the bottom of the upflow column12.

The upflow column 12 enters the regenerator 13 below an impingement separator 16 which brings about the separation of catalyst particles from the carrier gas. In the regenerator, the catalyst particles are then regenerated, in a manner which in itself is known, by burning off the coke deposited on their surface and the residual hydrocarbons with a stream of air or oxygen fed through a seventh line 17 to a second diffuser 18.

The particles of regenerated catalyst are removed by gravity through a first conduit 19 in the direction of the vessel 2 without heat loss.

At the top of the regenerator 13, the gases coming from the combustion are removed toward cyclones 23 in which the fines are separated from the gas. The fines are then recycled toward the regenerator through a second conduit 20, and the gases are removed through a seventh line 21.

Naturally, those skilled in the art can conceive of numerous variants of such an apparatus for carrying out the process of the invention.

The following examples which are not of a limiting nature illustrate the manner in which said process is carried out.

EXAMPLE 1

Three catalytic cracking tests were carried out using the two hydrocarbon feedstocks described in following Table 1:

TABLE 1

| Nature of the Treated Feedstock | A (Low nitrogen) | B (High nitrogen) |
|---|---|---|
| Density, °API | 17.7 | 18.5 |
| Sulfur, wt % | 2.42 | 0.9 |
| Hydrogen, wt % | 11.6 | 11.95 |
| Conradson carbon, wt % | 1.92 | 1.08 |
| Basic nitrogen, ppm | 350 | 1015 |
| 50% point on TBP curve, °C. | 470 | 475 |
| Vanadium, ppm | 1.5 | 1.0 |
| Nickel, ppm | 1.1 | 1.9 |

In the course of these three tests, feedstock A was cracked by the conventional upflow cracking process (Test 1). Feedstock B was treated by the conventional process (Test 2) and by the process of the invention (Test 3). In Tests 1 and 2, the same conventional catalyst was used. This was an acidic catalyst commercially available from the manufacturers GRACE DANISON, AKZO or ENGELHARD and chosen from the group of products known under the trade names SPECTRA, RESOC, OCTACAT, RESIDCAT, ORION, XP (GRACE), ADVANCE, OCTAVISION, VISION (AKZO), PRECISION and DIMENSION (ENGELHARD). These products have in common a pyridine adsorption capacity greater than 250 micromols/g under equilibrium conditions at 150° C. and a pressure of 5 mbar. In Test 3, the catalyst according to the invention was used.

Operating conditions were as shown in following Table 2:

TABLE 2

| Test | 1 | 2 | 3 |
|---|---|---|---|
| Catalyst injection temperature, °C. | 750 | 748 | 733 |
| Feedstock injection temperature, °C. | 233 | 250 | 250 |
| Temperature at reactor exit, °C. | 520 | 530 | 540 |
| C/O ratio | 4.9 | 5.4 | 7.8 |

The results collected in the following Table 3 show the harmful effect of basic nitrogen on the conversion (Test 2 compared to Test 1). They also show that the apparatus according to the invention makes it possible, by starting with a high-nitrogen feedstock (containing 1015 ppm of basic nitrogen), to obtain better feedstock conversion into liquefied petroleum gas, namely the ($C_3$+$C_4$) cut plus gasoline plus light cycle oil, as well as an appreciable reduction of coke deposit on the catalyst (delta coke) with an attendant, higher catalyst stability and reduced need for fresh catalyst (Test 3 compared to Test 2), as shown in the following Table 3:

TABLE 3

| Test | 1 | 2 | 3 |
|---|---|---|---|
| Dry gas, wt % | 4.1 | 4.0 | 4.0 |
| $C_3 + C_4$ cut, wt % | 13.4 | 10.0 | 12.1 |
| Gasoline, wt % | 41.4 | 38.1 | 41.2 |
| Light cycle oil, wt % | 18.9 | 19.1 | 18.7 |
| Heavy cycle oil, wt % | 17.3 | 23.7 | 17.4 |
| Coke, wt % | 4.9 | 5.1 | 6.6 |
| Conversion at 220° C., wt % | 63.8 | 57.2 | 63.9 |
| Conversion at 350° C., wt % ($C_3 + C_4$ + gasoline + light cycle oil) | 73.7 | 67.2 | 72.0 |
| Delta coke, wt % | 1.00 | 0.94 | 0.84 |

EXAMPLE 2

Three catalytic cracking tests were carried out with the high-nitrogen feedstock B described hereinabove using the downer process illustrated in FIG. 1. In these tests, the characteristics of the catalyst according to the invention were as follows in Table 4.

TABLE 4

| Test | 1 | 2 | 3 |
|---|---|---|---|
| Catalyst | A | B | C |
| Pyridine adsorbed at 150° C., mol/g | 550 | 200 | 45 |
| Pyridine retention after heating at 350° C. under vacuum % | 40 | 20 | 10 |
| Operating conditions were as follows: | | | |
| Catalyst injection temperature, °C. | 737 | 733 | 720 |
| Feedstock injection temperature, °C. | 250 | 250 | 250 |
| Temperature at reactor exit, °C. | 530 | 540 | 550 |
| C/O ratio | 6.2 | 7.8 | 11.5 |

The results collected show that by reducing the acidity of the cracking catalyst and by operating in accordance with the invention, it is possible to maximize the conversion of the high-nitrogen feedstock. These results are shown in Table 5, as follows:

TABLE 5

| Test | 4 | 5 | 6 |
|---|---|---|---|
| Dry gas, wt % | 3.8 | 4.0 | 4.2 |
| $C_3 + C_4$ cut, wt % | 10.8 | 12.1 | 14.3 |
| Gasoline, wt % | 39.1 | 41.2 | 43.8 |
| Light cycle oil, wt % | 20.7 | 18.7 | 17.4 |
| Heavy cycle oil, wt % | 20.0 | 17.4 | 11.8 |
| Coke, wt % | 5.6 | 6.6 | 8.5 |
| Conversion at 220° C., wt % | 59.3 | 63.9 | 70.8 |
| Conversion at 350° C., wt % ($C_3 + C_4$ + gasoline + light cycle oil) | 70.6 | 72.0 | 75.5 |
| Delta coke, wt % | 0.90 | 0.84 | 0.74 |

What is claimed is:

1. A fluidized-bed process for the catalytic cracking of a hydrocarbon feedstock having a high content of basic nitrogen compounds well in excess of 350 ppm by weight, in a tubular reaction zone having a top and a bottom, said process comprising the steps of:

a) feeding particles of at least partly regenerated catalyst at the top of the reaction zone into a catalyst feeding zone;

b) introducing and atomizing the feedstock to be treated at the top of the reaction zone below the catalyst feeding zone;

c) co-currently circulating the catalyst and the feedstock to be treated from the top to the bottom of the tubular reaction zone, in mutual contact, under catalytic cracking conditions to cause the cracking of the feedstock, wherein the catalyst under equilibrium conditions, at 150° C. and a pressure of 5 mbar, adsorbs less than 250 micromols of pyridine/g and whose pyridine retention after heating at 350° C. under vacuum does not exceed 20% of the amount adsorbed at 150° C. and wherein the weight ratio of catalyst to hydrocarbon feedstock ranges from about 7 to 15;

d) separating inactivated catalyst from products of the cracking reaction at the bottom of the reaction zone;

e) stripping the inactivated catalyst;

f) regenerating at least part of the stripped catalyst in a regeneration zone;

g) recycling the regenerated catalyst to the top of the reaction zone; and h) transferring the products resulting from the cracking of the hydrocarbon feedstock toward a separation zone for said products.

2. The process according to claim 1, wherein the catalyst under equilibrium conditions, at 150° C. and a pressure of 5 mbar, absorbs less than 50 micromols of pyridine/g.

3. The process according to claim 2, wherein the catalyst retention of pyridine after heating at 350° C. under vacuum does not exceed 10% of the amount adsorbed at 150° C.

4. The process according to claim 3, wherein the weight ratio of catalyst to hydrocarbon feedstock ranges from about 7 to 15.

5. The process according to claim 3, wherein the catalyst particles exit from the reaction zone at a velocity approximately equal to that of the products exiting the reaction zone.

6. The process according to claim 5, wherein the catalyst contains, in wt %, more than 30% of alumina and from 15 to 40% of at least one zeolite, the remainder up to 100% consisting at least in part of a diluent selected from the group consisting of kaolin, basic or slightly acidic clays, such as sepiolite and vermiculite, a binder based on silica and optionally a metal scavenger.

7. The process according to claim 6, wherein the catalyst particles and the products both exit from the reaction zone at a velocity of about 25 m/s.

8. The process according to claim 4, wherein the catalyst particles and the products both exit from the reaction zone at a velocity of about 25 m/s.

9. The process according to claim 1, wherein the catalyst retention of pyridine after heating at 350° C. under vacuum does not exceed 10% of the amount adsorbed at 150° C.

10. The process according to claim 1, wherein the weight ratio of catalyst to hydrocarbon feedstock is greater than 5.

11. The process according to claim 1, wherein the catalyst particles exit from the reaction zone at a velocity approximately equal to that of the products exiting the reaction zone.

12. The process according to claim 1, wherein the catalyst contains, in wt %, more than 30% of alumina and from 15 to 40% of at least one zeolite, the remainder up to 100% consisting at least in part of a diluent selected from the group consisting of kaolin, basic or slightly acidic clays, such as sepiolite and vermiculite, a binder based on silica and optionally a metal scavenger.

13. The process according to claim 1, wherein the hydrocarbon feedstock, has a high content of basic nitrogen compounds on the order of from 1015 ppm by weight and above.

14. A fluidized-bed process for the catalytic cracking of a hydrocarbon feedstock, having a high content of basic nitrogen compounds, in a tubular reaction zone having a top and a bottom, said process comprising the steps of:

a) feeding particles of at least partly regenerated catalyst at the top of the reaction zone into a catalyst feeding zone;

b) introducing and atomizing the feedstock to be treated at the top of the reaction zone below the catalyst feeding zone;

c) co-currently circulating the catalyst and the feedstock to be treated from the top to the bottom of the tubular reaction zone, in mutual contact, under catalytic cracking conditions to cause the cracking of the feedstock, wherein the catalyst under equilibrium conditions, at 150° C. and a pressure of 5 mbar, adsorbs less than 250 micromols of pyridine/g and whose pyridine retention after heating at 350° C. under vacuum does not exceed 20% of the amount adsorbed at 150° C., and wherein the catalyst contains, in wt %, more than 30% of alumina and from 15 to 40% of at least one zeolite, the remainder up to 100% consisting at least in part of a diluent selected from the group consisting of kaolin, basic or slightly acidic clays, such as sepiolite and vermiculite, a binder based on silica and optionally a metal scavenger;

d) separating inactivated catalyst from products of the cracking reaction at the bottom of the reaction zone, wherein the catalyst particles exit from the reaction zone at a velocity approximately equal to that of the products exiting the reaction zone;

e) stripping the inactivated catalyst;

f) regenerating at least part of the stripped catalyst in a regeneration zone;

g) recycling the regenerated catalyst to the top of the reaction zone; and h) transferring the products resulting from the cracking of the hydrocarbon feedstock toward a separation zone for said products.

15. The process according to claim 13, wherein the catalyst under equilibrium conditions, at 150° C. and a pressure of 5 mbar, absorbs less than 50 micromols of pyridine/g.

16. The process according to claim 13, wherein the catalyst retention of pyridine after heating at 350° C. under vacuum does not exceed 10% of the amount adsorbed at 150° C.

17. The process according to claim 13, wherein the weight ratio of catalyst to hydrocarbon feedstock is greater than 5.

18. The process according to claim 16, wherein the catalyst particles and the products both exit from the reaction zone at a velocity of about 25 m/s.

19. The process according to claim 17, wherein the weight ratio of catalyst to hydrocarbon feedstock ranges from about 7 to 15.

20. The process according to claim 13, wherein the hydrocarbon feedstock, has a high content of basic nitrogen compounds on the order of from 1015 ppm to 1300 ppm by weight.

* * * * *